US009515392B2

(12) United States Patent
Wong et al.

(10) Patent No.: US 9,515,392 B2
(45) Date of Patent: Dec. 6, 2016

(54) HIGH GAIN VARIABLE BEAM WI-FI ANTENNA

(71) Applicants: Gary Gwoon Wong, Torrance, CA (US); Calvin Gwoon Wong, Torrance, CA (US); Perry Gwoon Wong, Torrance, CA (US); Kalem Gwoon Wong, Torrance, CA (US)

(72) Inventors: Gary Gwoon Wong, Torrance, CA (US); Calvin Gwoon Wong, Torrance, CA (US); Perry Gwoon Wong, Torrance, CA (US); Kalem Gwoon Wong, Torrance, CA (US)

( * ) Notice: Subject to any disclaimer, the term of this patent is extended or adjusted under 35 U.S.C. 154(b) by 46 days.

(21) Appl. No.: 14/263,903

(22) Filed: Apr. 28, 2014

(65) Prior Publication Data

US 2015/0311592 A1 Oct. 29, 2015

(51) Int. Cl.

| | |
|---|---|
| ***H01Q 9/20*** | (2006.01) |
| ***H01Q 21/00*** | (2006.01) |
| ***H01Q 19/10*** | (2006.01) |
| ***H01Q 21/06*** | (2006.01) |
| ***H01Q 21/12*** | (2006.01) |

(52) U.S. Cl.

CPC ..... *H01Q 21/0075* (2013.01); *H01Q 19/108* (2013.01); *H01Q 21/062* (2013.01); *H01Q 21/12* (2013.01)

(58) Field of Classification Search

CPC .. H01Q 9/20; H01Q 21/0075; H01Q 21/062; H01Q 21/12; H01Q 19/108; H01Q 19/30

USPC ..... 343/813, 792.5, 810, 811, 812, 793

See application file for complete search history.

(56) References Cited

U.S. PATENT DOCUMENTS 1,964,189 A * 6/1934 Koomans ..... H01Q 21/062 343/813

2,266,868 A * 12/1941 Jakel ..... H01Q 21/12 333/125

(Continued)

*Primary Examiner* — Dameon E Levi

*Assistant Examiner* — Ab Salam Alkassim, Jr.

(57) ABSTRACT

This invention discloses a design and application of a variable beam antenna optimized for WI-HI application in data, video and voice transmission between various systems with an emphasis on medical monitoring. The subject antenna consists of a unique group of dipole radiators that are excited by zigzag feed lines and perform together as an array. This antenna is unique because it can provide various high gain beams by simply applying electrical shorts at the cross points in the feed lines. The shorts can be created mechanically or electronically. The antenna beam coverage can range from 15° to 110°- wide in H plane and maintains a constant beam width of 60° in E plane. The shorts are applied to reduce the antenna effective aperture, thereby increasing the beam width of the antenna. The current that flows to the outer dipoles are cut-off due to the shorts.

13 Claims, 1 Drawing Sheet

(56) References Cited

Figure 1:
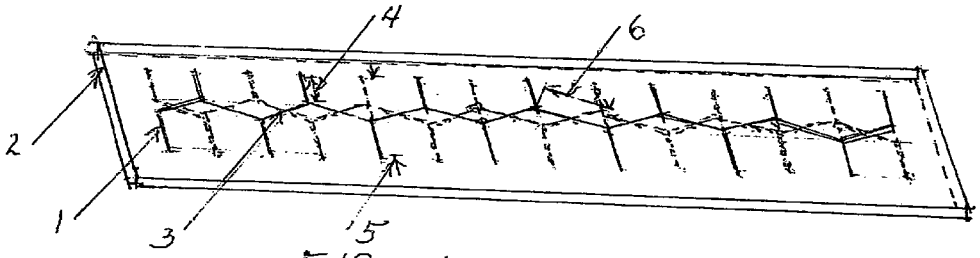

U.S. PATENT DOCUMENTS 2,429,629 A * 10/1947 Kandoian ..... H01Q 21/12 343/814
3,633,207 A * 1/1972 Ingerson ..... H01Q 11/10 343/770
4,203,118 A * 5/1980 Alford ..... H01Q 21/20 343/727
4,250,509 A * 2/1981 Collins ..... H01Q 21/24 343/806
5,541,613 A * 7/1996 Lam ..... H01Q 15/006 343/792.5
5,784,034 A * 7/1998 Konishi ..... H01Q 21/29 343/872
2004/0201525 A1* 10/2004 Bateman ..... H01Q 1/38 343/700 MS
2005/0253769 A1* 11/2005 Timofeev ..... H01Q 1/246 343/797
2005/0259027 A1* 11/2005 Grebel ..... H01Q 1/24 343/793
2009/0096698 A1* 4/2009 Semonov ..... H01Q 1/24 343/795
2009/0195471 A1* 8/2009 Semonov ..... H01Q 1/246 343/810
2014/0240186 A1* 8/2014 Zhou ..... H01Q 13/06 343/772

* cited by examiner

HIGH GAIN VARIABLE BEAM WI-FI ANTENNA

HIGH GAIN VARIABLE BEAM WI-FI ANTENNA

CROSS-REFERENCE TO RELATED APPLICATION

This application claims the benefit of U.S. Provisional Application No. 61/854,741 filled on May 1, 2013.

FIELD

This disclosure provides new art in design and fabrication of antenna to receive air wave signals specially relating to WI-FI systems.

SUMMARY OF THE INVENTION

A new design and application of a high performance high gain variable beam antenna for WI-FI application in data, video and voice transmission with emphasis in medical monitoring is disclosed. The subject antenna consists of a group of dipoles that are excited by two zigzag feed lines and perform together as an array to produce a high gain beam. The dipole are spaced approximately half a wavelength apart. Unlike ordinary array design approaches, this antenna avoids the use of more complicated phase and power splitting circuits. One continuous radiating element is utilized, instead of contemporary designs which require many radiators. This antenna employs half wavelength segments feed lines that are connected in series and alternate feeding the dipoles resulting an in phase current distribution on the dipole structure. Therefore, the entire group of dipole elements radiated as a collinear array. The polarization is vertical linear along the orientation of the dipoles. The dipoles are operated over a metal reflective ground plane. A novel feature of this antenna is that it is able to provide various high gain beams by applying simple electrical shorts at the cross points in the feed lines symmetrically away from the center dipole. The antenna structure is center fed from the middle.

The preferred embodiment structure has a set of unique cross points along the midpoint of zigzag feed line segments; the feed lines are located on the top and bottom surfaces of the circuit board.

The cross points on the feed lines of the preferred embodiment structure are used to form high gain radiation beams of the desired coverage pattern by applying electrical shorts at the cross points The dipoles of the preferred structure are operated over a metal reflective ground plane at a separation spacing approximately 0.2 wavelength of the center frequency.

The disclosure preferred embodiment structure contains 15 dipoles and has been tested to have a variable beam performance which can change the antenna beam coverage from 15° to 110° in H plane while maintaining a constant beam width of 60° in E plane. Fewer than 15 dipoles may be implemented, but the resulting antenna H plane beam width will be correspondingly larger.

The electrical shorts can be created in the preferred embodiment structure mechanically or electronically. A mechanical short is accomplished by making a mechanical join at a cross point in the feed line by means of a mechanical screw. An electronic short can be implemented with a pin diode switch imbedded into the feed line design.

The antenna shorts applied to the preferred embodiment structure has the effect of reducing the effective antenna aperture whereby increases the beam width of the antenna beam. The current flows to the outer dipoles are cut-off due to the electrical shorts.

The preferred embodiment structure can be utilized for transmission and reception of all audio and video signals in the UHF frequency band. It can be easily configure for Wi-Fi frequencies including the 2.5 and 5.0 GHz operating frequencies.

The preferred embodiment structure has a bandwidth performance greater than 20%. The antenna pattern side lobes and back lobes are extremely low; this is due to the effects of amplitude tapering of the current flowing outward from the center feed, and the power that radiates from each dipole is decreasing until the end dipole is reached.

The preferred embodiment structure can be produced by means of etching techniques whereby the dipoles circuit and feed lines are etched onto the respective side of a copper clad board.

The preferred embodiment structure may be excited by a split balun (balanced-to-unbalanced converter) in the input coaxial cable.

The preferred embodiment structure is passive and external power and frequency turning or adjustment is not required.

The preferred embodiment structure can be mounted on a wall with a hinge attached to the end of the structure body in such a way that the structure can easily hook to the wall for easy maneuver and pointing.

The preferred embodiment structure may use a foam material of proper thickness to maintain the desired separation from the ground plane and the body may be enclosed by an enclosure to be made of Abs plastic.

The preferred embodiment structure may be used in repeater application for cellular phone usage where high gain antenna is needed.

The preferred embodiment structure's high gain narrow beam radiation is designed to cover far away distance reception while the broad coverage beam is designed to accommodate closer distance reception.

DETAIL DESCRIPTION

The subject invention antenna consists of a group of dipoles that are uniquely excited by zigzag feed lines which enable the antenna to perform as an efficient array. The antenna composes of 15 dipole radiators which are operated over a ground plane to produce high gain beams.

Antenna Radiating Element Design

The radiating element is the most critical part of this invention. The invention antenna utilizes one long wire element to obtain various antenna beam widths.

The dipoles are spaced to accommodate the half wavelength segments of feed lines in order to bring about an in-phase excitation of all dipoles.

Another unique feature of this invention is that the antenna is designed with cross points that are applied to form high gain beams of desired coverage. The antenna radiating elements can be easily produced by mean of an etching technique. The dimensional tolerances are not critical.

FIG. 1 provides a prospective view of the element design. The antenna measures 4 wavelengths in H plane and 1 wave length in E plane. The antenna is configured to provide a variable beam of 15° to 110° in H plane. The E plane remains about 60°.

Good pattern characteristics have been obtained for a prototype model which was designed to perform over the frequency band of 1.0 GHz to 1.35 GHz. The FIG. 1 design is a direct scaling of the prototype model.

Base on the pattern data obtained, the directivities of the prototype antenna have been determined to be 16.6 and 8.8 dBil for the 15° and 90° beam. The efficiency of the antenna has been estimated to be 65%.

Antenna Enclosure

Figure 3:
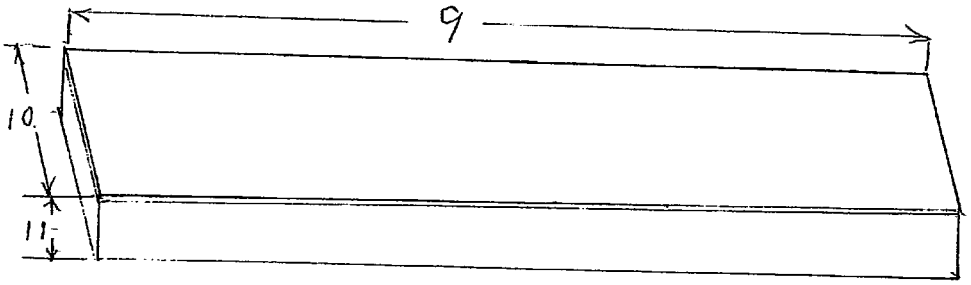

The FIG. 3 enclosure is designed to protect the radiating element. It can be made by bonding several Abs plastic pieces with a 4SC solvent. Wood panels may also be used for construction in place of Abs plastics.

Antenna Coverage Pattern

The coverage pattern of the invention antenna is a high gain beam of vertical polarization; the H plane pattern beam width can be changed by means of applying electrical shorts to the cross points on the feed lines. The horizontal polarization radiation is minimal because of the cancellation effects due to opposite current flow on the feed lines. The basic beam width is 15° by 60° without shorting pins.

DRAWINGS

FIG. 1—Radiating Element

FIG. 1 is a prospective view of one preferred embodiment of the subject invention containing a dipole array 1 etched onto a copper clad board 2. The outer dimensions are 4 wavelengths by 1 wavelength of the desired frequency. The cross points of the feed lines are 3.

For a design frequency 2.5 GHz, the outer dimensions are 19.0 by 4.7 by 1.0 inches. The dipole segment length 4 is 1.8 inches and the entire dipole length including the feed line gap 5 is 3.90 inches. The feed line segment length 6 is 2.35 inches. The impedance of the dipoles and feed lines are designed to be 150 to 300 ohms.

Figure 2:
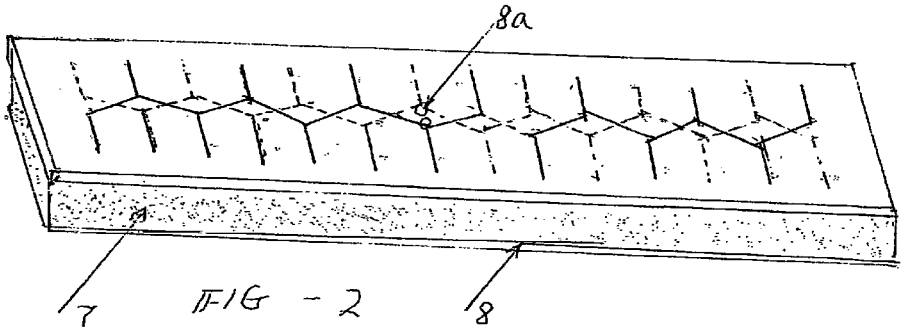

FIG. 2—Radiating Element and Ground Plane

FIG. 2 is the prospective view of FIG. 1 element on a foam support 7. The foam thickness 7 is 0.95 inches. The bottom of the foam support is the metal ground plane 8. The antenna input is connected to input terminals 8*a*. All dimensions are configured for a design frequency of 2.5 GHz.

FIG. 3—Antenna Enclosure

FIG. 3 is the prospective view of the enclosure which is designed to protect the radiating element. It is formed by bonding several Abs plastic pieces with a 4SC solvent. The outer dimensions 9, 10 and 11 are 19.5 by 5.0 by 1.1 inches. Again, the dimensions are configured for a design frequency of 2.5 GHz.

All dimensions given will be varied according to the design frequencies. For a frequency 5.0 GHz, all dimensions will be half.

The invention claimed is:

1. An antenna structure comprising:

a group of dipole radiating elements joined by two continuous zigzag feed lines positioned such that one group of the radiating elements located on a top surface of a circuit board is fed by one zigzag feed line and the opposing group of radiating elements on the bottom surface of the circuit board is fed by the other zigzag feed line, characterized in that the radiating structure forms a collinear array with the feed lines arranged in half wavelength segments in zigzag positions along the center of the horizontal line of the dipole elements such that each half wavelength segment of the top feed line crosses the center of the corresponding half wavelength segment of the bottom feed line, and the crossing points are electrically joined symmetrically away from the center dipole element to control the radiation of the antenna structure selectively;

the antenna structure is symmetrically fed from the center; and the dipoles are equal in length and are equally spaced.

2. The antenna structure in claim 1 where the two zigzag feed lines alternately connecting the top and bottom half of the dipole element on each side of the circuit board and has a dielectric sheet sandwiched in between, separating the front and backside of dipole elements.

3. The antenna structure in claim 1 consisting of a group of 15 dipoles separated approximately by half of a wavelength.

4. The antenna structure in claim 1 consists a ground plane located approximately 0.2 wavelength behind the dipole radiating elements.

5. The antenna structure in claim 1 the dipole elements are vertically orientated.

6. A method of exciting dipole radiating elements by joining a first group of radiating elements on the top surface of a circuit board with a first continuous zigzag feed line and a second group of radiating elements on the bottom surface of a circuit board with a second continuous zigzag feed line such that the feed lines are arranged in half wavelength segments in zigzag positions along the center of the horizontal line of the dipole elements and each half wavelength segment of the first feed line crosses the center of the corresponding half wavelength segment of the second feed line, the crossing points are electrical joined symmetrically away from the center dipole element to control the radiation of the antenna structure selectively;

the antenna structure is symmetrically fed from the center; and the dipoles are equal in length and are equally spaced.

7. The method in claim 6 where the two zigzag lines alternately connect the top and bottom half of the dipole elements on each side of the circuit board, a dielectric material sheet is sandwiched in between, separating the front and backside of dipole elements.

8. The method in claim 6 where the radiating elements consisting of a group of 15 dipole elements separated approximately by half of a wavelength.

9. The method in claim 6 further places a ground plane approximately 0.2 wavelengths behind the dipole radiating elements.

10. The method in claim 6 further places the radiating elements in a vertical orientation.

11. The method in claim 6 of applying zigzag feed lines in the antenna structure, alternatively feeding the dipoles to produce in phase currents on the dipole radiators in such a way a high gain beam of broadside radiation is obtained.

12. The method in claim 6 of increasing the pattern beam width from the antenna structure by selectively applying electrical shorts at the feed line crossing points.

13. The antenna structure in claim 1, the two opposing group of radiating elements are excited by a split balun with a coaxial connector located at the center of the structure.

* * * * *